US005379498A

United States Patent [19]

Nielsen et al.

[11] Patent Number: 5,379,498

[45] Date of Patent: Jan. 10, 1995

[54] METHOD AND APPARATUS FOR CONTROLLING SHEARING OF PILE FABRIC

[75] Inventors: Arne Nielsen, Oak Ridge; Majid Moghaddassi, Greensboro, both of N.C.

[73] Assignee: Guilford Mills, Inc., Greensboro, N.C.

[21] Appl. No.: 152,398

[22] Filed: Nov. 15, 1993

[51] Int. Cl.[6] ..... D06C 13/00

[52] U.S. Cl. ..... 26/15 R; 26/8 R

[58] Field of Search ..... 26/15 R, 18, 16, 7, 26/8 R, 9, 10 C, 8 C, 70

[56] References Cited

U.S. PATENT DOCUMENTS

| | | | |
|---|---|---|---|
| 3,683,468 | 8/1972 | Kaufman | 26/15 R |
| 3,769,666 | 11/1973 | Kaufman | 26/15 R |
| 3,908,245 | 9/1975 | Buthe | 26/15 R |
| 3,941,986 | 3/1976 | Santucci | 26/17 |
| 3,969,797 | 7/1976 | Riedel et al. | 26/15 R |

*Primary Examiner*—Clifford D. Crowder
*Assistant Examiner*—Amy Brooke Vanatta
*Attorney, Agent, or Firm*—Shefte, Pinckney & Sawyer

[57] ABSTRACT

Shearing operations on textile pile fabrics may be repeatably controlled precisely by controlling operating parameters of the shearing machine to maintain constant the average number of times each pile loop of the fabric is cut by the shearing blades of the shearing cylinder, which is accomplished by calculating a numeric value representing cuts per pile loop as a function of the rotational speed of the cylinder, its number of shearing blades, the widthwise dimension of the nose surface of the fabric rest, and the fabric traveling speed, and selectively adjusting one or more of these parameters as necessary to achieve the desired number of cuts per fabric loop.

8 Claims, 2 Drawing Sheets

METHOD AND APPARATUS FOR CONTROLLING SHEARING OF PILE FABRIC

BACKGROUND OF THE INVENTION

The present invention relates generally to machines and methods for shearing pile-type textile fabrics and, more particularly, to the control of such machines for producing reliably repeatable shearing results from one shearing operation to another.

The basic structure and operation of textile fabric shearing machines is well-known and has not changed significantly in recent years. Basically, textile shearing machines have a machine frame on which a shear cylinder, typically equipped with a plurality of helically or spirally extending shear blades projecting outwardly at circumferential spacings from the cylinder periphery, is mounted for driven rotation. A traveling length of a pile or plush textile fabric is trained through the machine about a series of guide rolls and is presented to the rotary periphery of the shear cylinder for cutting of the pile surface of the fabric by passing the fabric over an elongate cloth or fabric rest which extends in a stationery disposition on the machine frame alongside the periphery of the cylinder. An elongate ledger blade is similarly mounted on the frame alongside the cylinder periphery adjacent the fabric rest. The ledger blade has an arcuate surface conforming to the periphery of the cylinder, which surface terminates at a sharpened edge extending in shear cutting relation along the periphery of the cylinder at a close spacing to the fabric rest. In operation, as a pile or plush fabric is passed over the fabric rest, the fabric rests acts to cause the plush or pile surface of the fabric to extend into the nip area between the cutting edge of the ledger blade and the peripheral cutting blades of the shear cylinder so as to be severed to a desired degree determined by the relative spacing and dispositions of the cylinder, ledger blade, and fabric rest.

It is known to be important that the fabric deflecting surface or edge of the cloth rest and cutting edge of the ledger blade should be precisely linear and parallel to one another and also to the axis of the shear cylinder in order to insure uniform shearing of the plush or pile surface of the fabric so as to avoid production of second quality fabric. However, even with these operating components of the shearing machine in properly aligned disposition relative to one another, it is still difficult to repeatably produce comparable shearing results from one machine to another and from one roll of fabric to another, because other variables may affect the shearing operation, e.g., the rotational speed of the shearing cylinder, the traveling speed of the fabric, etc.

SUMMARY OF THE INVENTION

It is accordingly an object of the present invention to provide a method and apparatus by which the operation of a shearing machine may be controlled so as to reliably produce repeatable shearing results between differing rolls of the same fabric or from one fabric to another or from one machine to another.

Briefly summarized, the method and apparatus of the present invention are based on the theory that the shearing effect on any given fabric is ultimately a function of the number of times each pile loop of a pile fabric is engaged and cut by a shearing blade of the shearing cylinder. Thus, in accordance with the method and apparatus of the present invention, a numeric value is calculated to represent the number of times each loop of a given pile fabric will be cut by the shearing blades of the shearing cylinder as a function of certain operating parameters of the shearing machine, such as the rotational speed of the cylinder, the number of shearing blades thereon, the dimension of the fabric rest surface taken normal to the axis of rotation of the cylinder and the traveling speed of the fabric. One or more of the parameters may then be selectively adjusted in order to achieve a desired number of cuts of each pile loop of the fabric and thereby control the effect of shear cutting on the pile fabric.

In the preferred embodiment of the present method and apparatus, the numeric value for the number of cuts per loop of the fabric is calculated by dividing a numeric dwell time value ($T_d$) representing the time each pile loop resides on the fabric rest surface during fabric travel thereover by a numeric value ($T_c$) representing the number of cuts accomplished by the shearing blades of the cylinder per minute. The dwell time value ($T_d$) is calculated according to the following equation:

$$T_d = \frac{W_{cr}}{S_f}$$

wherein $W_{cr}$ is the dimension of the fabric rest surface normal to the axis of rotation of the cylinder and Sf is the traveling speed of the fabric. The numeric cuts per minute value ($T_c$) is calculated according to the equation:

$$T_c = \frac{1}{S_r \cdot N_s}$$

wherein $S_r$ is the rotational speed of the cylinder and $N_s$ is the number of shearing blades thereon.

DESCRIPTION OF THE PREFERRED EMBODIMENT

Figure 1:
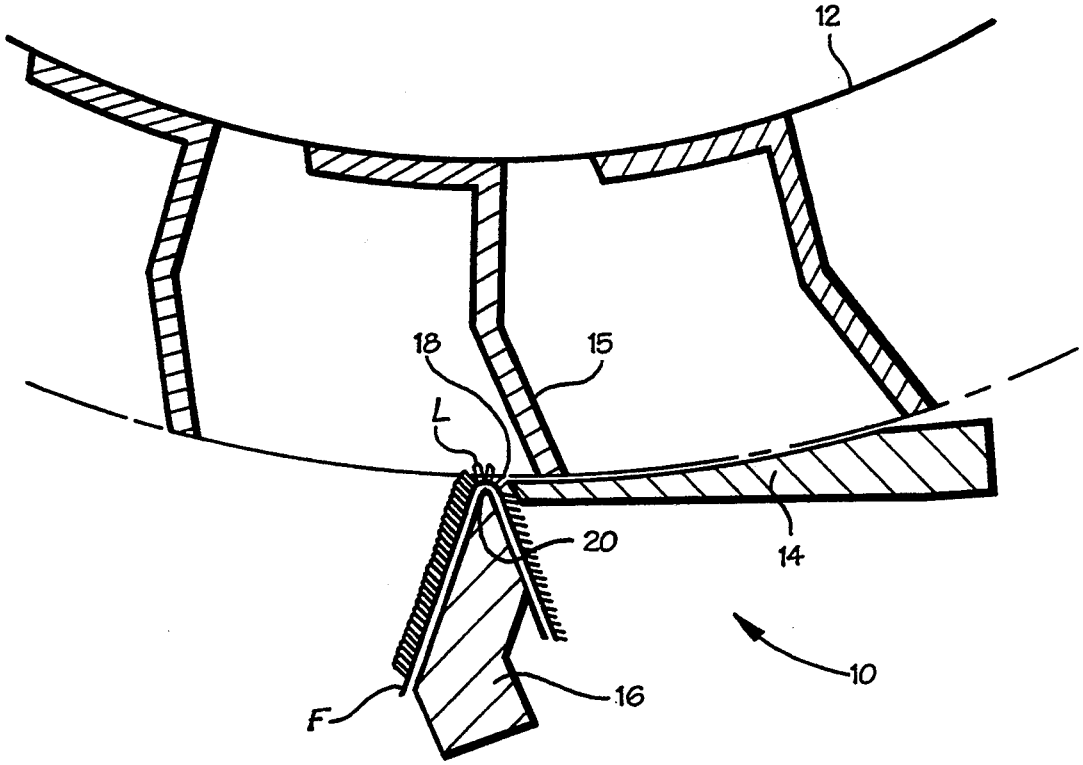
FIG. 1 is a cross-sectional view taken vertically through the shear cylinder, fabric rest, and ledger blade of a typical conventional textile fabric shearing machine, depicting the operational relationships of such components.

Referring now to the accompanying drawings and initially to FIG. 1, the basic operating components of a conventional textile shearing machine are indicated generally at 10 in vertical cross-section and essentially comprise a shearing cylinder 12, a ledger blade 14, and a fabric rest 16, each of which is mounted to a machine frame (not shown).

The shearing cylinder 12 is rotatably supported by the machine frame at its opposite end with a central drive shaft (not shown) connected through an appropriate drive arrangement with a variable speed drive motor (not shown). The cylindrical periphery of the cylinder carries a plurality of spirally extending cutting blades 15 extending outwardly from the cylinder at circumferential spacings from one another. The fabric rest 16 and the ledger blade 14 extend widthwise across the machine frame co-extensively with the shearing cylinder 12. The forward side of the ledger blade 14 is formed with an upwardly facing longitudinal cutting edge 18 extending immediately adjacent the periphery of the shearing cylinder 12 to be in shear cutting relation with its entire length, the upwardly facing surface of the ledger blade 14 rearwardly of the cutting edge 18 being formed with an arcuately concave curvature conforming to the peripheral circumference of the shearing cylinder 12. The fabric rest 16 extends immediately forward of the ledger blade 14 at a close spacing thereto and is of a tapered cross-section narrowing upwardly to a longitudinal deflecting nose 20 extending at a close forward spacing to the cutting edge 18 of the ledger blade 14. Appropriate guide rolls (not shown) train a fabric to travel from a supply roll (also not shown) through the shearing machine upwardly over the forward side of the fabric rest 16, then downwardly through the spacing between the fabric rest 16 and the ledger blade 14, and therefrom over additional guide rolls (not shown) to a take-up roll (also not shown).

As depicted in FIG. 1, in basic operation of the shearing machine, the fabric is deflected over the nose 20 of the fabric rest 16 causing the pile loops L of the fabric F to project into the path of the cutting blades 15 on the shearing cylinder 12 so as to be cut by the shearing action between the blades 15 and the cutting edge 18 of the ledger blade 14.

As will be seen, as each widthwise course of the fabric's pile loops L progresses over the nose 20 of the fabric rest 16 each succeeding course of loops L can be subjected to two or more cuts by the succeeding spiral blades 15 of the cylinder 12. It is well-known that the linearity, parallelism, and relative spacing of the cylinder 12, the ledger blade 14, and the fabric rest 16 affect the nature of the shearing operation and the shearing effect on any given fabric. Even so, it is difficult to repeatably produce the same shearing effect on differing rolls of the same or different fabrics even when these physical characteristics of the shearing machine may be kept constant. It has now been discovered that a factor which fundamentally affects the shearing effect on a fabric by any given shearing operation is the number of times each pile loop of a pile fabric is cut by the shearing blades of the shearing machine cylinder, which in turn, is affected by several different operating parameters of a shearing machine, most notably the rotational speed of the cylinder 12, the number of shearing blades 15 thereon, the widthwise dimension of the nose 20 of the fabric rest 16 measured normal to the axis of rotation of the cylinder and the traveling speed of the fabric F. Based on this realization, the present invention seeks to control the repeatability of a shearing operation by controlling the number of shearing cuts per pile loop of fabric accomplished during the shearing operation.

Specifically, in accordance with the present invention, a series of mathematical equations have been developed for calculating a numeric value representing the number of times each pile loop of a fabric will be cut by the shearing blades 15 of the shearing cylinder 12 based upon the aforementioned operating parameters of the machine. A numeric value is calculated for the dwell time ($T_d$) each pile loop L of the fabric F resides on the nose 20 of the fabric rest 15 during fabric travel thereover, by solving the following equation:

$$T_d = \frac{W_{cr}}{S_f \cdot x}$$

wherein $W_{cr}$ is the widthwise dimension of the upper surface of the nose 20 of the fabric rest 16 measured normal, i.e., perpendicularly, to the axis of rotation of the cylinder 12, expressed in a lineal unit of measure, e.g., inches, $S_f$ is the linear speed in yards per minute at which the fabric F travels over the fabric rest 16, expressed in lineal travel per unit time, e.g., yards per minute, and x is a conversion factor, e.g., 36 for converting the fabric speed to inches per minute. Likewise, a numeric value ($T_c$) is calculated for the number of cuts accomplished per minute by the rotational action of the cutting blades 15 on the shearing cylinder 12, by solving the following equation:

$$T_c = \frac{1}{S_r \cdot N_s}$$

wherein $S_r$ is the rotational speed of the shearing cylinder 12 expressed in revolutions per unit time and $N_s$ is the number of shearing blades 15 on the cylinder 12.

By dividing the numeric dwell time value $T_d$ by the numeric cuts per minute value $T_c$, a numeric value $N_c$ is obtained representing the average number of times each pile loop L of the fabric F will be cut by the succeeding shearing blades 15 of the cylinder 12 during an ongoing shearing operation. By recording and observing these operating parameters during a given shearing operation, the shearing effect obtained on the fabric F can be precisely controlled throughout the shearing operation by monitoring and maintaining constant the relevant operating parameters, e.g., through appropriate sensors for the rotational cylinder speed and the fabric traveling speed and a suitable controller, e.g., a microprocessor, for adjusting as necessary the related drive components. Likewise, by duplicating the number of cuts per loop of fabric in another shearing operation, the same shearing effect can be precisely repeated, even on a different shearing machine.

Figure 2:
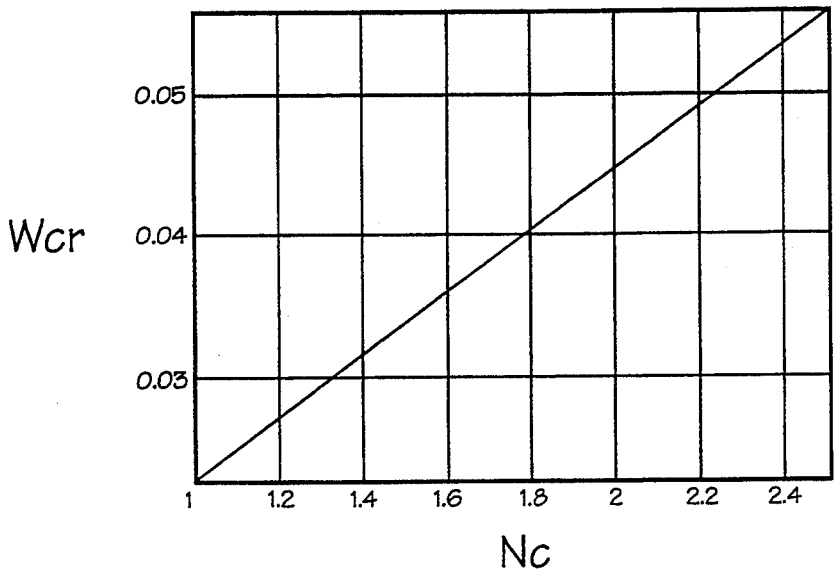
FIG. 2 is a graph plotting the relationship between the widthwise dimension of the fabric rest, i.e., normal to the axis of rotation of the cylinder, and the number of times each pile loop of a fabric will be cut by a shearing blade of the shearing cylinder, when other variable parameters of the shearing operation are constant.
Figure 3:
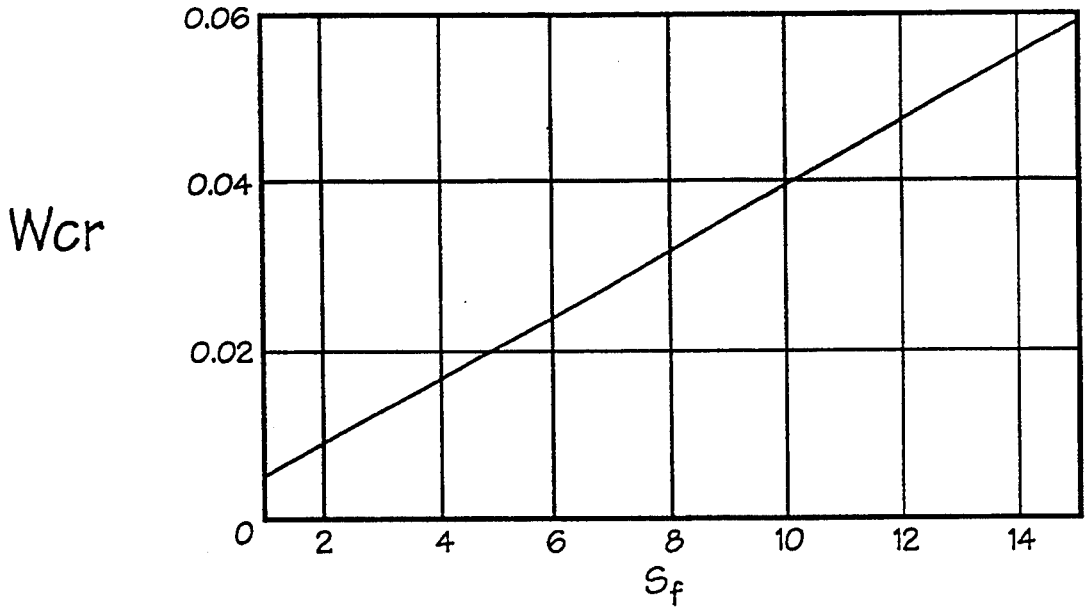
FIG. 3 is a graph showing the relationship between the widthwise dimension of the fabric rest and the traveling speed of the fabric which is necessary to achieve a constant number of cuts of each loop of a fabric by the shearing blades of the shearing cylinder when other variable parameters of the shearing operation remain constant.
Figure 4:
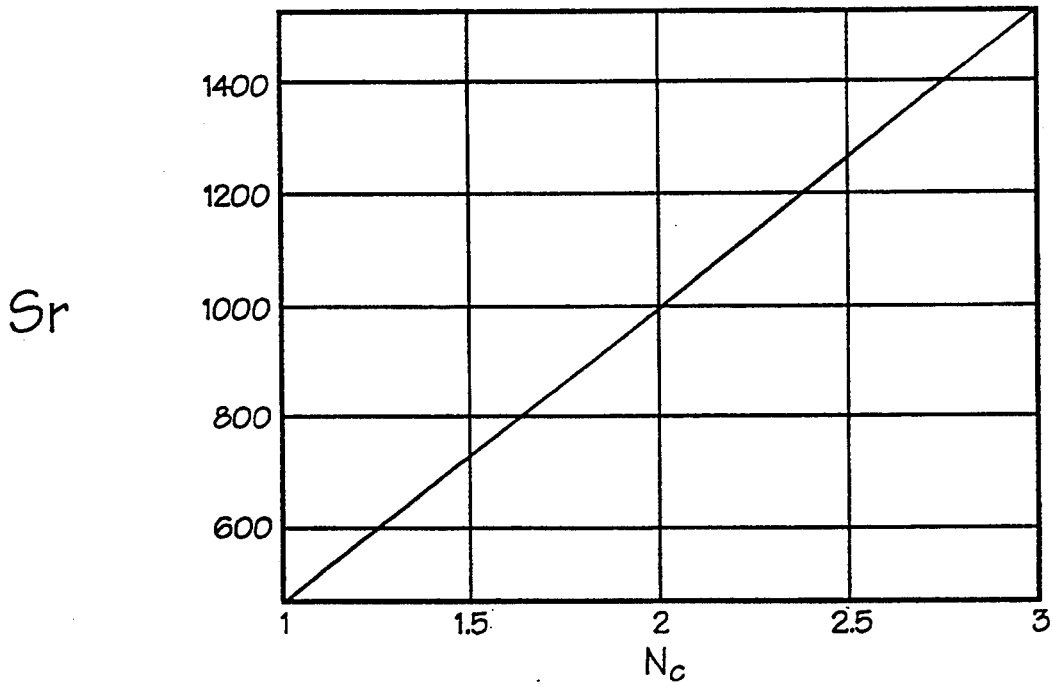
FIG. 4 is a graph showing the relationship between the rotational speed of the shearing cylinder and the number of cuts of each pile loop of a fabric by the shearing blades of the shearing cylinder when other variable parameters of the shearing operation remain constant.

FIGS. 2–4 further illustrate the relationship between the operating parameters. In FIG. 2, the relationship between the widthwise dimension of the fabric rest ($W_{cr}$) and the number of cuts per loop of fabric ($N_c$), assuming other operating parameters of the shearing operation remain constant, is illustrated in graph form. Similarly, the graph of FIG. 3 shows the relationship between the widthwise dimension of the cloth rest ($W_{cr}$) and the traveling speed of the fabric ($S_f$) necessary in order to maintain a constant number of cuts per loop per fabric ($N_c$), all other operating parameters remaining constant. In the graph of FIG. 4, the relationship between the rotational speed of the cylinder ($S_r$) and the number of cuts per loop of fabric ($N_c$) is shown, assuming all other variables of the shearing operation remain constant. As will be seen in each case, a direct linear relationship exists between these variables.

By way of example, assuming a shearing operation wherein the linear traveling speed of the fabric ($S_f$) is ten yards per minute, the rotational speed of the cylinder 12 ($S_r$) is nine hundred revolutions per minute, the number of spiral cutting blades 15 on the cylinder 12 is eighteen and the width of the nose 20 of the fabric rest 16 ($W_{cr}$) is 0.0394 inches, the numeric dwell time value ($T_d$) would be $1.09\times10^{-4}$ minutes and the numeric cuts per minute value ($T^c$) would be $6.17\times10^{-5}$ cuts per minute, whereby the number of times each pile loop L of the fabric F will be cut by the shearing blades 15 will average 1.77 cuts per loop. So long as this number of cuts per loop is repeated on a succeeding roll of the same fabric, even on a differing machine, the same shearing effect should be achieved provided that the physical arrangement and spacing of the shearing cylinder 12, the ledger blade 14 and the fabric rest 16 are the same.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of controlling the shearing of pile loops of a pile fabric in a shearing machine having a rotatably driven shear cylinder supporting a plurality of circumferentially-spaced shearing blades and a fabric rest surface extending alongside the periphery of the cylinder for fabric travel over the fabric rest to present the fabric tufts to the shearing blades for shear-cutting, the method comprising calculating a numeric value representing the number of times each loop of the fabric will be cut by the shearing blades of the shearing cylinder as a function of predetermined parameters including the rotational speed of the cylinder, the number of shearing blades thereon, the dimension of the fabric rest surface normal to the axis of rotation of the cylinder, and the traveling speed of the fabric, and selectively adjusting at least one of the predetermined parameters for achieving a desired number of cuts of each loop of the fabric, thereby to control the effect of shear-cutting on the pile fabric.

2. A method of controlling the shearing of a pile fabric according to claim 1, wherein the numeric value for the number of cuts per loop of fabric is calculated by dividing a numeric dwell time value ($T_d$) representing the time each pile loop resides on the fabric rest surface during fabric travel thereover by a numeric value ($T_c$) representing the number of cuts accomplished by the shearing blades of the cylinder per minute.

3. A method of controlling the shearing of a pile fabric according to claim 2 wherein the dwell time value ($T_d$) is calculated according to the equation:

$$T_d = \frac{W_{cr}}{S_f}$$

wherein $W_{cr}$ is the dimension of the fabric rest surface normal to the axis of rotation of the cylinder and $S_f$ is the traveling speed of the fabric.

4. A method of controlling the shearing of a pile fabric according to claim 3 wherein the numeric cuts per minute value ($T_c$) is calculated according to the equation:

$$T_c = \frac{1}{S_r \cdot N_s}$$

wherein $S_r$ is the rotational speed of the cylinder and $N_s$ is the number of shearing blades thereon.

5. Apparatus for controlling the shearing of pile loops of a pile fabric in a shearing machine having a rotatably driven shear cylinder supporting a plurality of circumferentially-spaced shearing blades and a fabric rest surface extending alongside the periphery of the cylinder for fabric travel over the fabric rest to present the fabric tufts to the shearing blades for shear-cutting, the apparatus comprising means for calculating a numeric value representing the number of times each loop of the fabric will be cut by the shearing blades of the shearing cylinder as a function of predetermined parameters including the rotational speed of the cylinder, the number of shearing blades thereon, the dimension of the fabric rest surface normal to the axis of rotation of the cylinder, and the traveling speed of the fabric, and means for selectively adjusting at least one of the predetermined parameters for achieving a desired number of cuts of each loop of the fabric, thereby to control the effect of shear-cutting on the pile fabric.

6. Apparatus for controlling the shearing of a pile fabric according to claim 1, wherein the numeric value for the number of cuts per loop of fabric is calculated by dividing a numeric dwell time value ($T_d$) representing the time each pile loop resides on the fabric rest surface during fabric travel thereover by a numeric value ($T_c$) representing the number of cuts accomplished by the shearing blades of the cylinder per minute.

7. Apparatus for controlling the shearing of a pile fabric according to claim 6 wherein the dwell time value ($T_d$) is calculated according to the equation:

$$T_d = \frac{W_{cr}}{S_f}$$

wherein $W_{cr}$ is the dimension of the fabric rest surface normal to the axis of rotation of the cylinder and $S_f$ is the traveling speed of the fabric.

8. Apparatus for controlling the shearing of a pile fabric according to claim 7 wherein the numeric cuts per minute value ($T_c$) is calculated according to the equation:

$$T_c = \frac{1}{S_r \cdot N_s}$$

wherein $S_r$ is the rotational speed of the cylinder and $N_s$ is the number of shearing blades thereon.

* * * * *